US008874354B2

(12) United States Patent
Lederman et al.

(10) Patent No.: US 8,874,354 B2
(45) Date of Patent: Oct. 28, 2014

(54) METHOD AND SYSTEM FOR EXPANSION OF REAL-TIME DATA ON TRAFFIC NETWORKS

(75) Inventors: Roger Lederman, Brooklyn, NY (US); Laura Wynter, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 1176 days.

(21) Appl. No.: 11/872,941

(22) Filed: Oct. 16, 2007

(65) Prior Publication Data

US 2009/0099760 A1 Apr. 16, 2009

(51) Int. Cl.
*G08G 1/01* (2006.01)

(52) U.S. Cl.
CPC ..... *G08G 1/0104* (2013.01)
USPC ..... 701/117; 701/118

(58) Field of Classification Search
CPC ..... G08G 1/0104
USPC ..... 701/117, 118; 370/235
See application file for complete search history.

(56) References Cited

U.S. PATENT DOCUMENTS

| | | | | |
|---|---|---|---|---|
| 6,490,519 | B1 | 12/2002 | Lapidot et al. | |
| 6,882,930 | B2 * | 4/2005 | Trayford et al. | 701/117 |
| 2006/0176817 | A1 | 8/2006 | Liu et al. | |
| 2006/0178806 | A1 * | 8/2006 | Liu et al. | 701/117 |
| 2006/0206256 | A1 * | 9/2006 | Kumagai et al. | 701/117 |

OTHER PUBLICATIONS

"Dynamic OD Matrix Estimation from Link Counts: An Approach Consistent with DTA" http://www.entpe.fr/Dr/Licit/Niveau3/Publications/2006/Durlin_Henn_Leeds2006_Poster.pdf.
Josefsson and Patriksson, "Sensitivity Analysis of Separable Traffic Equilibrium Equilibria with Application to Bilevel Optimization in Network Design" [Transportation Research Part B, vol. 41, Issue 1, Jan. 2007, pp. 4-31], (Abstract only).

* cited by examiner

*Primary Examiner* — Helal A Algahaim
*Assistant Examiner* — Charles J Han
(74) *Attorney, Agent, or Firm* — Daniel P. Morris; McGinn IP Law Group, PLLC

(57) ABSTRACT

A method and structure of estimating traffic in a network. A real-time estimate of the network traffic is calculated, based on limited real-time data about the network traffic calculated in an offline phase and limited real-time data received in a real-time phase.

20 Claims, 5 Drawing Sheets

METHOD AND SYSTEM FOR EXPANSION OF REAL-TIME DATA ON TRAFFIC NETWORKS

CROSS-REFERENCE TO RELATED APPLICATIONS

The present application is related to the following co-pending application:

U.S. patent application Ser. No. 11/052,310, filed on Feb. 7, 2005, to Liu et al., entitled "Method and Apparatus for Estimating Real-Time Travel Times Over a Transportation Network Based on Limited Real-Time Data", having IBM Docket YOR920050046US1, assigned to the present assignee, and incorporated herein by reference.

BACKGROUND OF THE INVENTION

1. Field of the Invention

The present invention generally relates to estimating real-time travel times or traffic loads (e.g., traffic flows or densities) over a transportation or data or IP network based on limited real-time data. More specifically, a two-phase method estimates travel time over a transportation network comprising at least a first link having a real time data feed and a second link not having a real time data feed, by receiving the data feed for the first link, estimating a first travel time over the first link based at least in part on the data feed, and estimating a second travel time over the second link, also based at least in part on the data feed for the first link, as well as other known data, such as historical traffic patterns and physical parameters of the transportation network. The first phase is performed off-line, in advance, and the second phase is performed in real-time as the most recent data is received.

2. Description of the Related Art

The present invention relates to traffic networks, including at least transportation networks and data, or IP, networks. In the case of transportation networks, such as shown exemplarily in FIG. 1, showing a portion 100 of a transportation network in a city, data on the state of the network, in terms of volumes or flows, is generally not available across all links of the network at all points in time. A point in time refers to the instant at which an average volume or flow is made available for a link on the network.

Generally, 1-minute, 5-minute, 10-minute, or 15-minute average volumes or flows are provided in a real-time configuration. A real-time data feed therefore provides such short-term averages every time period. At any such period, it is typically the case that not all links have data associated with them.

Real-time sensor data is an important input into traffic management systems on networks. In practice, however, sensor data is not available on all links of a network at each instant in time, or even during each time "period", and in some cases, data is simply not collected on all links all the time. In other cases, obtaining the data on all links at all time points would be too costly.

However, incomplete data on the state of the network makes the use of numerous traffic management and/or dissemination tools inefficient or inaccurate. Hence, it is of great interest to network managers to possess a method or system providing a consistent set of real-time data and estimates on the state of the network.

Similarly, in data or IP networks, it is typically the computation burden of obtaining the real-time flows or volumes on all links of a network that makes the data obtained limited. The limitation of the data is therefore both spatial (not covering all links at a particular point in time) and temporal (not covering a given link at all points in time).

On the other hand, many analytical tools for use with real-time data on networks require a complete picture of the network state at each time instant. An example for transportation networks is a dynamic routing algorithm. On an IP network an example is a performance analysis algorithm.

For example, U.S. Pat. No. 6,490,519, entitled "Traffic monitoring system and methods for traffic monitoring and route guidance useful therewith", to Lapidot et al., addresses monitoring of network traffic through data from mobile communications devices. It is noted that, unlike the method of the present invention, Lapidot et al. does not involve expansion of observed data to links for which no real-time data has been collected.

The publication "Dynamic OD matrix estimation from link counts: An approach consistent with Dynamic Traffic Assignment" (Durlin and Henn, 2006) discusses real-time estimation of link flows in elementary networks. The objective is different from that of the present invention, in that the authors seek to determine dynamic OD (origin/destination) matrices rather than complete the network link volumes on a real network. The approach is similar in some ways in that it uses equilibrium assignment principles to calculate flows for unobserved links. However, there is no method for extending this beyond very simple and specialized networks.

Thus, a need exists for an accurate method to determine flows or volumes on traffic links that do not have complete capability for real-time data.

SUMMARY OF THE INVENTION

In view of the foregoing, and other, exemplary problems, drawbacks, and disadvantages of the conventional systems, it is an exemplary feature of the present invention to provide a method (and structure) to provide a very accurate method for determining the flows or volumes on the links which do not have associated with them real-time data.

It is, therefore, an exemplary feature of the present invention to provide a structure and method for determining traffic in a network involving vehicles on a network of roadways or involving information traffic on an information network, such as a data or IP network, when the network lacks complete sensing of current traffic.

It is another exemplary feature of the present invention to provide a traffic estimation method in networks having incomplete traffic information, wherein historical traffic data is used in an offline phase to calculate baseline traffic information for a network, such that the offline phase traffic information is then used to estimate a complete model of traffic during an on-line phase for the entire network.

It is another exemplary feature of the present invention to provide a traffic estimation system and method that can selectively provide current traffic information into either a related system, such as a system controlling traffic in the network, or an unrelated system, such as a navigation system providing navigational guidance to a driver of a vehicle using a local traffic network, even if the local traffic network lacks a complete sensing of current traffic.

To achieve the above exemplary features and objects, in a first exemplary aspect of the present invention, described herein is an apparatus, including a calculator to produce real-time estimates of network traffic, the real-time estimates being based on limited real-time data about the network traffic calculated in an offline phase and limited real-time data received in a real-time phase.

In a second exemplary aspect of the present invention, also described herein is a computerized method to provide real-time estimates of network traffic, as based on limited real-time data about the network traffic calculated in an offline phase and limited real-time data received in a real-time phase.

In a third exemplary aspect of the present invention, also described herein is a machine-readable medium encoded with a computer program to execute a computerized method to provide real-time estimates of network traffic, as based on limited real-time data about the network traffic calculated in an offline phase and limited real-time data received in a real-time phase.

The present invention, therefore, provides a method for a complete picture of a network through real-time estimates consistent with the real-time observations.

Additionally, the present invention can provide those real-time estimates into other analytical tools (such as assignee's Traffic Prediction Tool) and get future predicted estimates on the full network. The real-time or future predicted estimates can also be used as input into routing tools (such as an in-vehicle guidance system, Garmin and such), for providing a user the best route, as a function of traffic, even if sensor data is not available.

The present invention could also be used to provide inputs into traffic control software (e.g., a system that adjusts traffic signal timings, etc.).

BRIEF DESCRIPTION OF THE DRAWINGS

The foregoing and other purposes, aspects and advantages will be better understood from the following detailed description of an exemplary embodiment of the invention with reference to the drawings, in which.

DETAILED DESCRIPTION OF EXEMPLARY EMBODIMENTS OF THE INVENTION

Figure 1:
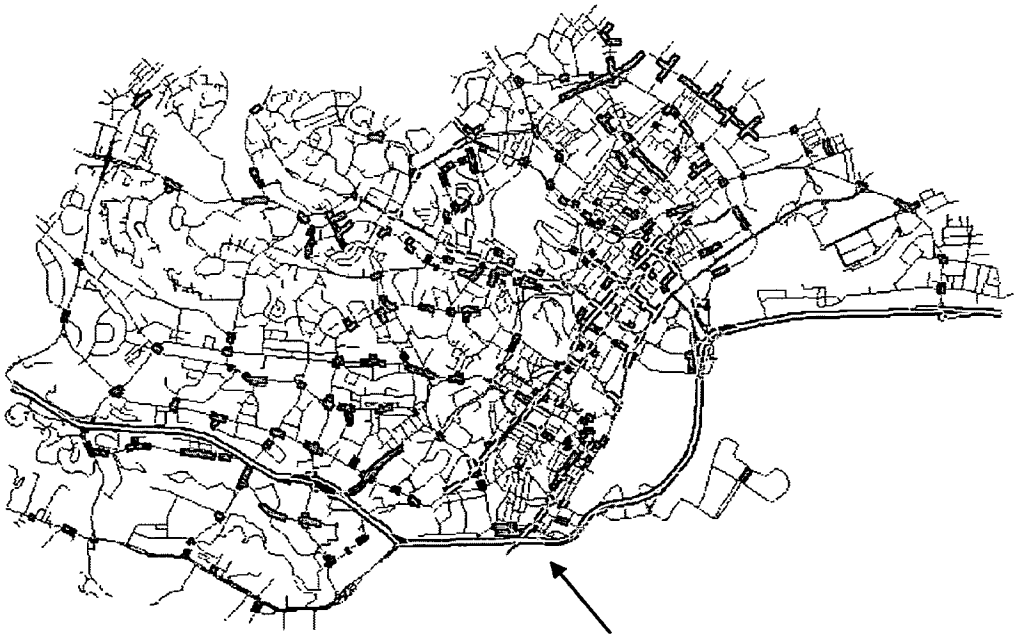
FIG. 1 exemplarily shows a portion 100 of a city traffic network.

Referring now to the drawings, and more particularly to FIGS. 1-7, there are shown exemplary embodiments of the method and structures according to the present invention.

The present invention provides a technique for taking real time data on a traffic network and expanding it to obtain consistent real-time estimates on the parts of the traffic network for which real-time data was not available. The method makes use of descriptive traffic models in an offline estimation phase and has a real-time phase in which the intermediate output created in the offline estimation phase is used in another set of calculations along with the most recent real-time data to provide real-time estimates across the network.

Thus, in one aspect, the invention can make use of additional information about the network and the use of the network, in the offline phase, in order to improve the quality of the estimates produces in the real-time phase. In another aspect, the present invention can take into account information on incidents in the real-time data.

On road traffic networks, sensor data on traffic volumes are provided by traffic sensor data systems. Typically, however, there are large gaps both in geographic coverage of the network at a given time point, and in the temporal coverage of a given location on the network. Road traffic management authorities are keenly interested in a tool or technique to "fill in the gaps" of the data, both spatially and temporally.

Similar problems exist in data networks. Whereas the sensors are present on all links of an IP network, for example, obtaining the sensor readings on all links at all time points is prohibitively costly. Hence, an analogous need exists for data and IP networks, and the present invention can be applied to any traffic situation where obtaining sensor readings on all links at all times is either not realistic or practical.

US Patent Publication No. US20060176817A1, the above-identified co-pending application, involves real-time expansion of real-time data, based on available historical data. In comparison, the present invention further involves an offline phase for expansion of historical real-time observations to all links and multiple system states, facilitating accurate real-time expansion. Thus, the method of the present invention makes use of a paradigm introduced in the above-referenced co-pending patent application, but provides a two-phase method for providing a more complete solution to this problem.

The first phase is an off-line phase that makes use of data which has been stored, for example, for several days, weeks, or months (e.g., historical data on the traffic). The second phase, performed on the real-time data, uses the values computed in the first, off-line phase, to obtain accurate estimates of the link flows or volumes not provided in the real-time data, thereby providing a real-time estimate of traffic for the complete network, as based upon filling in the missing link flows based upon the historical data.

Thus, in contrast to conventional methods, the present invention includes two phases, the off-line phase and the real-time phase. The collected data may be stored from the real-time feed of volume or flow data. Time is divided into segments which are believed to have similarity in the behavior of the traffic flow or volume. A time segment may be an hour of a day for a particular day of the week, for example.

For example, in one instance the collected data might span several weeks, with a time segment designed to be an hour of the day for a particular day of the week, such as Monday at 7:00-8:00 am. In this scenario, the offline phase might be re-solved, for example, each week, and the results of the off-line phase applied as new real-time data is provided.

Therefore, one aspect of the problem being addressed is that of estimating traffic volume on all links of a road network in real-time, using a combination of current and historical data from road sensors, and, in general, both the current and historical observations contain data for only a subset of the links in the network.

In one exemplary embodiment, for the real-time estimation problem (J), a least-squares formulation is used, with linear equality constraints whose parameters are determined through an additional off-line optimization problem. The off-line calibration problem (Q) exemplarily takes the form of a bi-level program.

To be explained in more detail shortly, the present invention offers two possible formulations for the real-time estimation. First, the average-based formulation can be calibrated using only historical averages of link volumes. Second, the observation-based formulation requires a collection of cross-sectional link volume observations to calibrate.

For each formulation, a direct calibration problem is considered that fits the parameters of the linearly constrained model directly to historical data. Next, a path-based calibration introduces equilibrium constraints to describe likely driver behavior. An algorithm for solving the resulting mathematical program with equilibrium constraints, or the bilevel program, is then discussed. We also exemplarily use a gradient-projection method to solve a sensitivity problem, as presented in a paper by Josefsson and Patriksson [Transportation Research Part B, Volume 41, Issue 1, January 2007, Pages 4-31], for the lower-level traffic equilibrium to obtain the necessary gradients.

Figure 3:
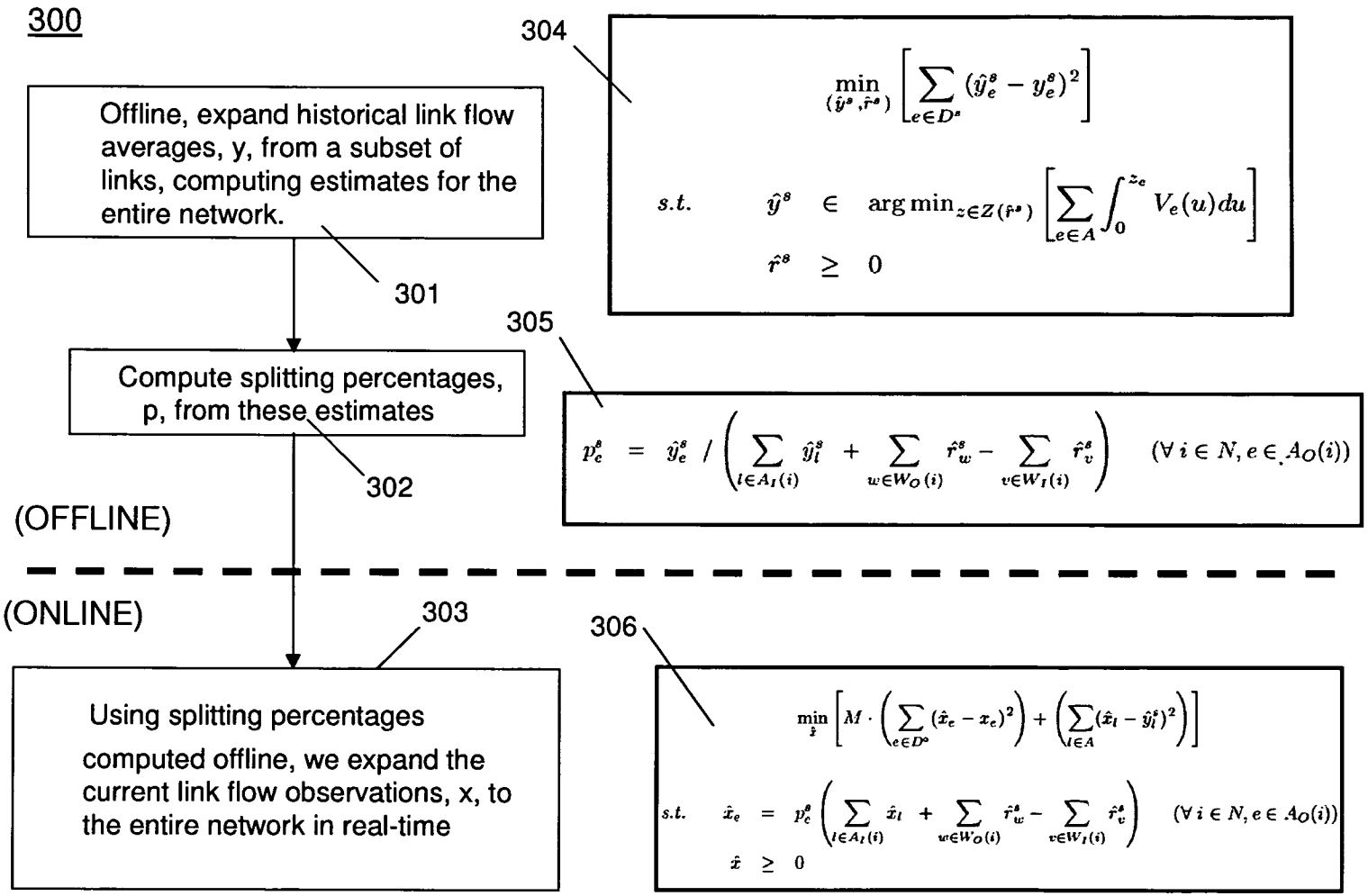
FIG. 3 shows a first exemplary approach 300 to achieve the offline/online phases of the present invention.

FIG. 3 shows a flowchart 300 of an exemplary implementation using the average-based formulation discussed above, and FIG. 4 show a flowchart 400 of an exemplary implementation of the observation-based formulation. In both figures, the offline calculations 301, 302, 401, 402 are shown above the dotted line and the online calculations 303, 403 are shown below this dotted line.

As shown in FIG. 3, the first step 301 in the average-based formulation is the offline expansion of historical link flow averages to compute estimates for the entire network. In step 302, these estimates are used to compute splitting percentages p, so that the on-line step 303 can use these splitting percentages to expand the current link flow observation to the entire network. The corresponding equations 304, 305, 306 are shown to the right in FIG. 3 and will be explained in depth in the discussion below.

Figure 4:
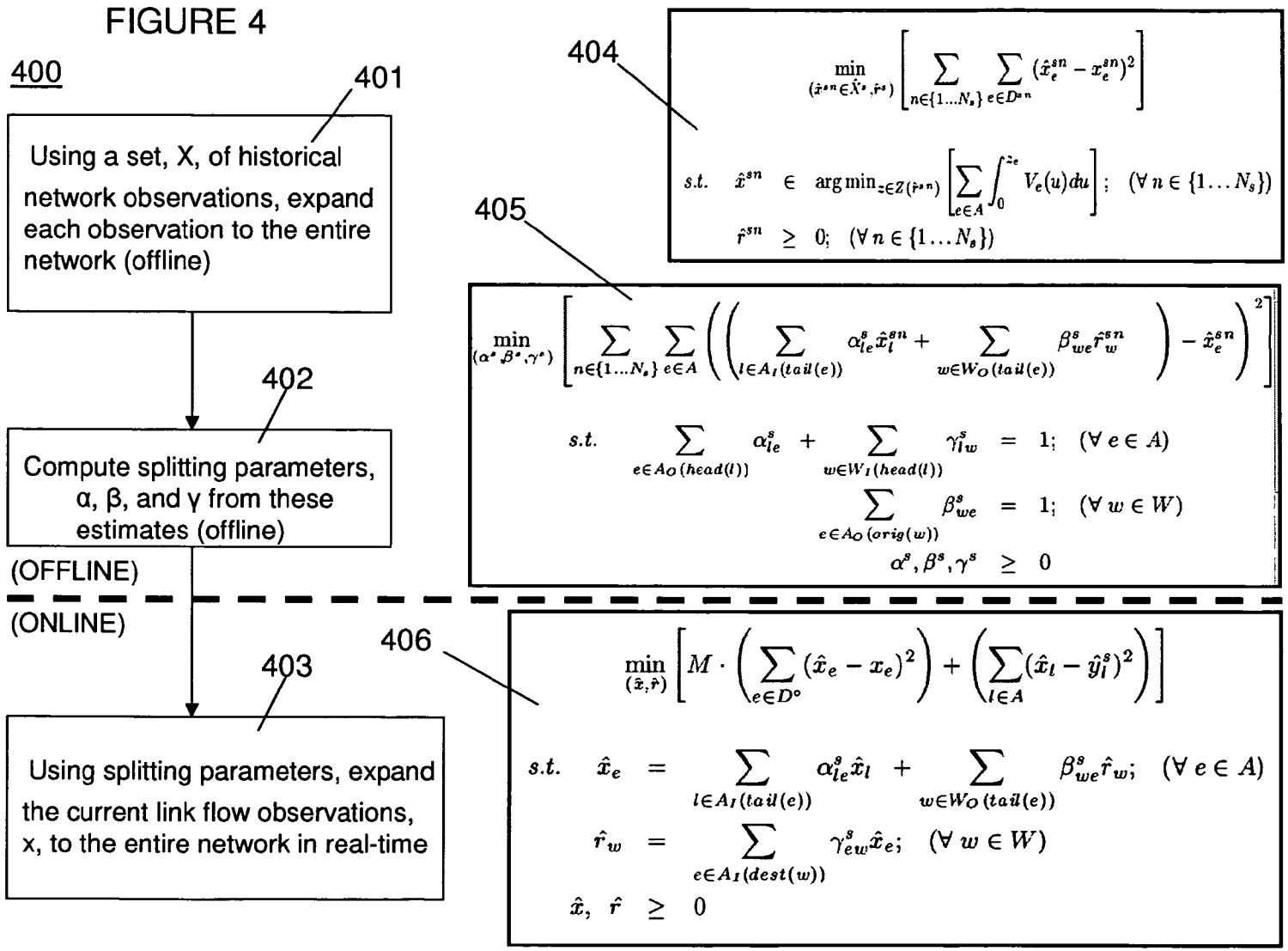
FIG. 4 shows a second exemplary approach 400 to achieve the offline/online phases of the present invention.

As shown in FIG. 4, the first step 401 in the observation-based formulation is the offline expansion of historical network observations to compute estimates for the entire network. In step 402, these estimates are used to compute splitting parameters α, β, γ, so that the on-line step 403 can use these splitting parameters to expand the current link flow observation to the entire network. The corresponding equations 404, 405, 406 are shown to the right in FIG. 4 and will also be explained in the discussion below.

Section 1 below describes the notation used in the present invention. Section 2 then describes both formulations of the real-time estimation problem and presents the associated direct calibration problems. In Section 3, several possible path-based calibration problems are formulated, along with an algorithmic approach.

Section 1: Notation

The graph G(N,A) represents the traffic network, with N being the set of nodes, and A the set of links interconnecting the nodes. Each arc $e \in A$ is directed from a tail node to a head node head(e)∈N. For each node i∈N, we define the sets:

$$A_o(i):=\{e\in A \mid \text{tail}(e)=i\} \text{ and } A_I(i):=\{e\in A \mid \text{head}(e)=i\}.$$

Figure 2:
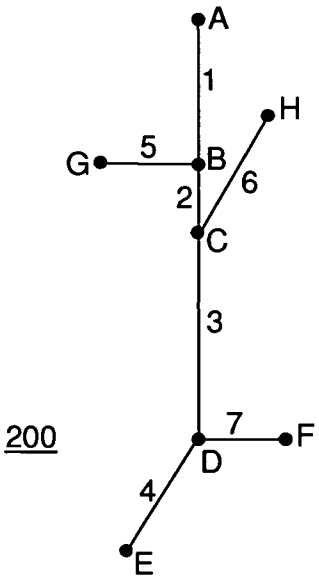
FIG. 2 exemplarily shows a simple network 200 of eight nodes.

Thus, FIG. 2 exemplarily shows a simple network 200 having N=8 nodes (e.g., nodes A→H) and A=7 links (e.g., links 1→7), but a realistic traffic network would typically contain tens or hundreds, if not thousands of such nodes and links.

Let $W \subset N \times N$ be a set of origin-destination (OD) pairings. For each pairing w=(orig(w),dest(w))∈W, there is a demand for travel from orig(w) to dest(w). Traffic enters the network at orig(w), bound for dest(w), at a rate $r_w$. For each node i∈N, we define the sets: $W_o(i):=\{w\in W \mid \text{orig}(w)=i\}$ and $W_I(i):=\{w\in W \mid \text{dest}(w)=i\}$. The OD demands for the network are contained in the |W|−vector, r. The set of demands that may be realized is restricted to the set $R \subset R^{|W|}$.

Drivers choose a path from their origin to their destination. Let P be the set of possible paths through the network. For each w∈W we define the set $P_w \subset P:=\{k\in P, k \text{ from orig}(w) \text{ to dest}(w)\}$. $z_k$ is the volume of flow on path k, with the property that $\Sigma_{k\in P_w} z_k = r_w$.

We relate paths and links through a set of indicator functions. $1_e^k$ is equal to 1 if link e is contained in path k. $x_e$ is the volume of flow on link e, with the property that $x_e=\Sigma_{k\in P} 1_e^k z_k$. Travel time on a link is dependent on link volume. The link travel time, $c_e$, is determined by a function, $c_e(V_e(x_e))$. Path travel time, $h_k$, is defined by summing link travel times, so that $h_k=\Sigma_{e\in A} 1_e^k c_e$.

We denote the volume of flow on link e at the current time as $x_e^0$. We are only able to observe a subset of the link volumes, so that $x^0$, the collection of data in the current observation consists only of $x_e^0$ for $e\in D^0 \subset A$. The real-time observation problem is to determine volume estimates, $\tilde{x}_e^0$, for all links e∈A.

In dealing with historical data, observations are divided into segments, each corresponding to a set of time intervals (e.g., 7-8 AM, Monday-Friday). We create S segments, so that each observation falls into a segment s∈{1 . . . S}. We will call the segment associated with the current observation $s^O$. Historical data is thus represented by a set $X^S=\{x^{s1} \ldots x^{sN_s}\}$ for each segment s∈{1 . . . S}, where $X^{sn}$ contains the historical link volume observations, $x_e^{sn}$ for each link $e\in D^{sn} \subset A$. We define the set $D^s=\cup_{n\in\{1 \ldots N_s\}} D^{sn}$ containing links for which there is some amount of historical data for time segment s.

Observed historical average volumes $y^s$ are calculated for each segment s∈{1 . . . S}. Since not all links necessarily have historical data, $y^s$ consists only of $y_e^s$ for $e\in D^s$. $y_e^s$ is calculated from real-time observations for segment s as $y_e^s=(\Sigma_{(n:e\in D^{sn})} x_e^{sn})/(\Sigma_{\{1 \ldots N_s\}} 1\{e\in D^{sn}\})$ for $e\in D^S$.

Estimated observations $\hat{X}^s=\{\hat{x}^{x1}, \ldots \hat{x}^{xN_s}\}$ are determined for each s∈{1 . . . S}. Each contains estimates $\hat{x}_e^s$ for all e∈A. Estimated averages $\hat{y}_e^s$ are determined for each s∈{1 . . . S} and e∈A. We allow for demands that differ across segments by defining $r^s$, the mean demand rates for segment s, along with the feasible set $R^s \subset R|W|$ for each segment s∈{1 . . . S}. The mean rates $r^s$ apply to all times within segment s, but the actual demand at any time point is assumed to vary around this mean. We thus allow for a set $\hat{r}^s=\{\hat{r}^{s1}, \ldots \hat{r}^{sN_s}\}$ of distinct demand estimates for each observation for segment s.

Section 2: Real-Time Estimation

The real-time estimation problem assumes the existence of a calibrated set of parameters $\Psi^s$ for each segment. For each arc e∈A, $\Psi^s$ contains the weights $\{\alpha_{le}^s; l\in A_I(\text{tail}(e))\}$ and $\{\beta_{we}^s; w\in W_O(\text{tail}(e))\}$. For each OD pair w, $\Psi^s$ contains the weights $\{\gamma_{ew}^s; e\in A_I(\text{dest}(w))\}$. It is also assumed that a full set, $\hat{y}^s$, of link flow averages has been estimated.

The calibrated parameters define a model such that a flow $x^s$ is expected to satisfy the constraints:

$$x_e^s = \sum_{l\in A_I(tail(e))} \alpha_{le}^s x_l^s + \sum_{w\in W_O(tail(e))} \beta_{we}^s r_w^s \tag{1}$$

$$r_w^s = \sum_{e\in A_I(dest(w))} \gamma_{ew}^s x_e^s$$

$$x_e \geq 0 (\forall\, e \in A)$$

We denote the set of pairs $(x^s, r^s)$ satisfying (1) as $L_w(\Psi^s)$.

The weights are interpreted in terms of propagating of traffic through the network. $\alpha_{le}^s$ is the proportion of the flow on link l that continues onto link e. $\gamma_{lw}^s$ is the proportion of flow on link l that does not move beyond node head(l) because it satisfies a demand w with head(l) as its destination. $\beta_{we}$ is the proportion of demand w, which enters the network at node orig(w), that leaves that node on link e. As such, weights will satisfy $\Sigma_{e\in A_O(head(l))}\alpha_{le}^{s}+\Sigma_{w\in W_l(head(l))}\gamma_{lw}^{s}=1$ for each link l and $\Sigma_{e\in A_O(orig(w))}\beta_{we}^{s}=1$ for each OD pair w.

The general form of the estimation problem $J(x^O, \hat{y}^{s^O}, \Psi_s^O)$, is:

$$\min_{(\hat{x}^O,\hat{r}^s)}\left[M\left(\sum_{e\in D}\hat{x}_e^O-x_e^O\right)^2+\left(\sum_{e\in A}\hat{x}_e^O-\hat{y}_s^{s^O}\right)^2\right] \tag{2}$$

$$\text{s.t. } (\hat{x}^s, \hat{r}^s)\in L_w(\Psi^s) \tag{3}$$
$$\hat{r}^s\in R^s$$

Here, M is a large positive constant. Unless otherwise stated, $R^s$ contains only nonnegativity constraints for each term $r_w^s$.

Average-Based Formulation

In the average-based formulation, the set $\Psi_{avg}^s$ is restricted to weights where all flow into a node is propagated in the same proportions. Specifically, if tail(e) is the node i, then the weights $\{\alpha_{le}^s; l\in A_I(i)\}$ and $\{\beta_{we}^s w\in W_O(i)\}$ all take the same value, $p_e^s$. Similarly, if dest(w) is node i, then $\{\gamma_{ew}^s; e\in A_I(i)\}$ all take the value $q_w^s$. Given link flow averages, $\hat{y}^s$, the weights can be computed uniquely by $p=\hat{y}_e^s/(\Sigma_{l\in A_I 1}\hat{y}_l^s+\Sigma_{v\in W_O(i)}\hat{r}_v^s)$ and $q_w^s=r_w^s/(\Sigma_{l\in A_I(i)}\hat{y}_l^s+\Sigma_{v\in W_O(i)}\hat{r}_v^s)$. $L_w(\Psi_{avg}^s)$ is then the set of pairs $(x^s, r^s)$ satisfying:

$$x_e^s=\sum_{l\in A_I(i)}p_e^s x_l^s+\sum_{v\in W_O(i)}p_e^s r_v^s(\forall\, i\in N, e\in A_O(i)) \tag{4}$$
$$r_w^s=\sum_{l\in A_I(i)}q_w^s x_l^s+\sum_{w\in W_O(i)}q_w^s r_v^s(\forall\, i\in N, w\in W_I(i))$$
$$x_e^s\geq 0(\forall\, e\in A)$$

The average based formulation of the estimation problem is given by $J(x^O, \hat{y}^{s^O}, \Psi_{avg}^{s^O})$. $\Psi_{avg}^s$ can be directly by solving $K_{avg}(y^s)$:

$$\min_{(\Psi_{avg}^s,\hat{y}^s,\hat{r}^s)}\left[\sum_{e\in D^s}\hat{y}_e^s-y_e^s)^2\right] \tag{5}$$
$$\text{s.t. } (\hat{y}^s, \hat{r}^s)\in L_W(\Psi_{avg}^s)$$
$$\sum_{e\in A_O(i)}p_e^2+\sum_{w\in W_I(i)}q_w^2=1(\forall\, i\in N) \tag{6}$$
$$p^s\geq 0$$
$$q^s\geq 0$$
$$\hat{r}^s\in R^s$$

Observation-Based Formulation

For the observation-based formulation, we remove the restrictions that were placed on $\Psi_{avg}^s$. In order to calibrate this more general set of weights $\Psi_{obs}^s$, we look explicitly at each of the cross-sectional observations $x^{sn}\in X^s$. Once $\Psi_{obs}^s$ has been calibrated, we define the set L $(\Psi_{obs}^s)$ by the equations in (1). The observation-based formulation of the estimation problem is given by $J(x^O, \hat{y}^{s^O}, \Psi_{obs}^{s^O})$.

We calibrate $\Psi_{obs}^s$ directly by solving $K_{obs}(X^s)$:

$$\min_{(\Psi_{obs}^s,\hat{x}^s,\hat{r}^s)}\left[\sum_{n\in\{1\ldots N_s\}}\sum_{e\in D^{sn}}(\hat{x}_e^{sn}-x_e^{sn})^2\right] \tag{7}$$
$$\text{s.t. } (\hat{x}^{sn}, \hat{r}^{sn})\in L_w(\Psi_{obs}^2)(\forall\, n\in\{1\ldots N_s\})$$

$$\sum_{e\in A_O(head(l))}\alpha_{le}^s+\sum_{w\in W_I(head(l))}\gamma_{lw}^s=1(\forall\, e\in A) \tag{8}$$
$$\sum_{e\in A_O(orig(w))}\beta_{we}^s=1(\forall\, w\in W)$$
$$\alpha^s, \beta^s, \gamma^s\geq 0$$
$$\hat{r}^{sn}\in R^s(\forall\, n\in\{1\ldots N_s\})$$

Section 3: Path-Based Calibration

To help estimate link volumes, we will assume that drivers choose shortest paths. As a result, path flows should satisfy conditions for Wardrop Equilibrium:

$$P_k\in P_{mn}, z_k>0\Rightarrow h_k\leq h_l \text{ for all } P_l\in P_{mn} \tag{9}$$

Our calibration approach will be to extend historical observations to the entire network by estimating the most likely Wardrop Equilibria, as determined by the link flows that have been observed. We will then use the estimated historical data to calibrate for the weights needed.

For a given vector r of demands, the set Z(r) of feasible flows is given by all flows, x, that satisfy the following:

$$x_e=\sum_{P_k\in P}1_e^k(\forall\, e\in A) \tag{10}$$
$$\sum_{P_k\in P_w}z_k=r_w(\forall\, w\in W)$$
$$x_e\geq 0(\forall\, e\in A)$$

In order to find an equilibrium corresponding to the demands r, we solve a convex optimization problem over the set Z(r). $L_p(r)$, the set of feasible equilibria corresponding to demand r is defined by:

$$\{x^*\in Z(r):\Sigma(V_e(x_e^*)(x_e-x_e^*))\geq 0, \forall x\in Z(r)\} \tag{10}$$

Equivalently, $L_p(r)$ consists of those elements of Z(r), for which (9) is satisfied.

Average-Based Formulation

The offline estimation problem for the average based formulation is given by $Q_{avg}(y^s)$:

$$\min_{(\hat{y}^s,\hat{r}^s)}\left[\sum_{e\in D^s}(\hat{y}_e^s-y_e^s)^2\right] \tag{12}$$
$$\text{s.t. } \hat{y}^s\in L_p(\hat{r}^s)$$
$$\hat{r}^s\in R^s \tag{13}$$

Given estimated link flow averages, $\hat{y}^s$, $\Psi_{avg}^s$ is then computed uniquely by $p_s^s=\hat{y}_e^s/(\Sigma_{l\in A_I(i)}\hat{y}_l^s+\Sigma_{w\in W_O(i)}\hat{r}_w^s)$ and $p=\hat{r}_w^s/(\Sigma_{l\in A_I(i)}\hat{y}_l^s)$.

Observation-Based Formulation

The offline estimation problem for the observation based formulation is given by $Q_{obs}(X^s)$:

$$\min_{(\hat{x}^s,\hat{r}^s)}\left[\sum_{n\in\{1\ldots N_s\}}\sum_{e\in D^{sn}}(\hat{x}_e^{sn}-x_e^{sn})^2\right] \tag{14}$$

$$\text{s.t. } \hat{x}^{sn}\in L_p(\hat{r}^{sn})$$

$$\hat{r}^{sn}\in R^s(\forall\, n\in\{1\ldots N_s\}) \tag{15}$$

Given estimated link flow observation $\hat{X}^s$, $\Psi_{obs}{}^s$ is calibrated by solving:

$\hat{K}_{obs}(\hat{X}^s,\hat{r}^s)$:

$$\min_{(\Psi_{obs}^s)}\left[\sum_{n\in\{1\ldots N_s\}}\sum_{e\in A}\left(\left(\sum_{l\in A_I(tail(e))}\alpha_{le}^s\hat{x}_l^{sn}+\sum_{w\in W_O(tail(e))}\beta_{we}^s\hat{r}_w^{sn}\right)-\hat{x}_e^{sn}\right)^2\right] \tag{16}$$

$$\text{s.t. } \sum_{e\in A_O(head(l))}\alpha_{le}^s+\sum_{w\in W_I(head(l))}\gamma_{lw}^s=1(\forall\, e\in A)$$

$$\sum_{e\in A_O(orig(w))}\beta_{we}^s=1(\forall\, w\in W)$$

$$\alpha^s,\beta^s,\gamma^s\geq 0 \tag{17}$$

Exemplary Software Implementation

Figure 5:
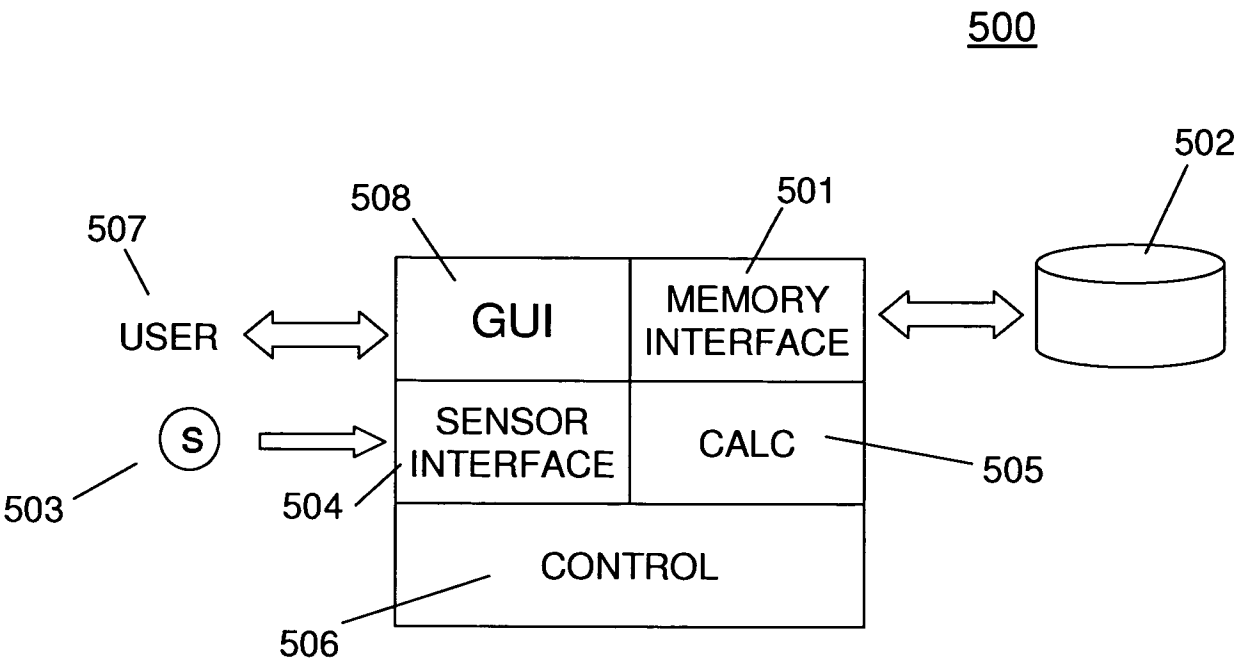
FIG. 5 shows an exemplary block diagram 500 of software modules that could be used to implement the method of the present invention.

FIG. 5 shows an exemplary block diagram 500 showing a possible application program that could implement the methods of the present invention. The memory interface module 501 interfaces with memory 502 storing information on the network, including historical data. Sensors 503 provide data to the sensor interface module 504, which data could be transferred to memory 502 via memory interface module 501. Calculator module 505 performs the calculations described in the equations above, and control module 506 interconnects the software modules, possibly as a main program. Graphical user inter face 508 permits user inputs to control the application as well as the mechanism to display results.

Exemplary Hardware Implementation

Figure 6:
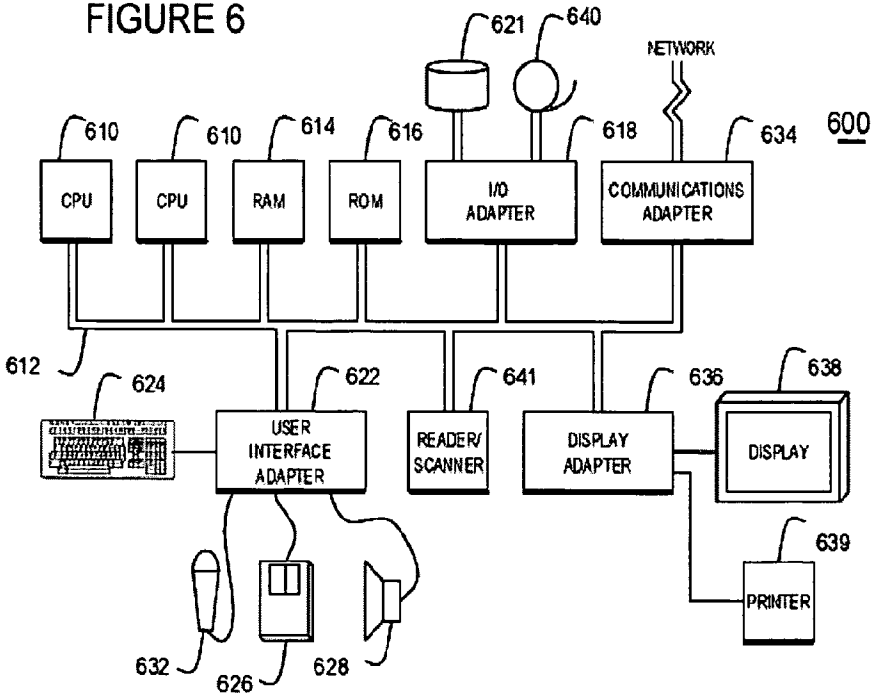
FIG. 6 illustrates an exemplary hardware/information handling system 600 for incorporating the present invention thereon.
Figure 7:
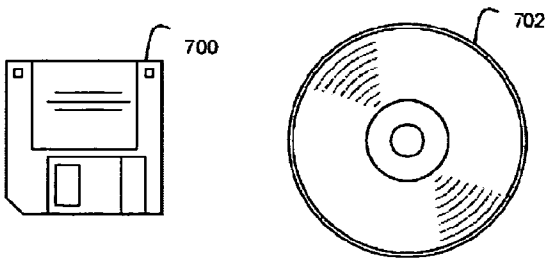
FIG. 7 illustrates a signal bearing medium 700 (e.g., storage medium) for storing steps of a program of a method according to the present invention.

FIG. 6 illustrates a typical hardware configuration of an information handling/computer system in accordance with the invention and which preferably has at least one processor or central processing unit (CPU) 611.

The CPUs 611 are interconnected via a system bus 612 to a random access memory (RAM) 614, read-only memory (ROM) 616, input/output (I/O) adapter 618 (for connecting peripheral devices such as disk units 621 and tape drives 640 to the bus 612), user interface adapter 622 (for connecting a keyboard 624, mouse 626, speaker 628, microphone 632, and/or other user interface device to the bus 612), a communication adapter 634 for connecting an information handling system to a data processing network, the Internet, an Intranet, a personal area network (PAN), etc., and a display adapter 636 for connecting the bus 612 to a display device 638 and/or printer 639 (e.g., a digital printer or the like).

In addition to the hardware/software environment described above, a different aspect of the invention includes a computer-implemented method for performing the above method. As an example, this method may be implemented in the particular environment discussed above.

Such a method may be implemented, for example, by operating a computer, as embodied by a digital data processing apparatus, to execute a sequence of machine-readable instructions. These instructions may reside in various types of signal-bearing media.

Thus, this aspect of the present invention is directed to a programmed product, comprising signal-bearing media tangibly embodying a program of machine-readable instructions executable by a digital data processor incorporating the CPU 611 and hardware above, to perform the method of the invention.

This signal-bearing media may include, for example, a RAM contained within the CPU 611, as represented by the fast-access storage for example. Alternatively, the instructions may be contained in another signal-bearing media, such as a magnetic data storage diskette 700 (FIG. 7), directly or indirectly accessible by the CPU 611.

Whether contained in the diskette 700, the computer/CPU 611, or elsewhere, the instructions may be stored on a variety of machine-readable data storage media, such as DASD storage (e.g., a conventional "hard drive" or a RAID array), magnetic tape, electronic read-only memory (e.g., ROM, EPROM, or EEPROM), an optical storage device (e.g. CD-ROM, WORM, DVD, digital optical tape, etc.), paper "punch" cards, or other suitable signal-bearing media including transmission media such as digital and analog and communication links and wireless. In an illustrative embodiment of the invention, the machine-readable instructions may comprise software object code.

The present invention provides a complete picture of a traffic network through real-time estimates consistent with the real-time observations, even if the network has incomplete sensing capability. The real-time estimates can be provided as inputs into other analytical tools, such as assignee's Traffic Prediction Tool, and get future predicted estimates on the full network. The real-time or future predicted estimates can also be used as input into routing tools (such as in the in-vehicle guidance systems, Garmin and such, for instructing the user with the best route as a function of traffic, even if sensor data was not available. In this scenario, the input could be provided as subscription service through a local server or as an input into a larger guidance service.

The present invention could also provide input into traffic control software (i.e. that adjusts traffic signal timings, etc), or it could be used as a backup mechanism for systems that do have more complete sensing, much as an auxiliary system that can be used during failures of the primary system or during periods when one or more sensors in the system have failed, or could be used to provide information for determining a redirection of traffic during a failure or during a traffic incident. As an auxiliary system, the invention might function primarily in the offline mode, being switched into the online mode as conditions required.

While the invention has been described in terms of exemplary embodiments, those skilled in the art will recognize that the invention can be practiced with modification within the spirit and scope of the appended claims.

Further, it is noted that, Applicants' intent is to encompass equivalents of all claim elements, even if amended later during prosecution.

Having thus described our invention, what we claim as new and desire to secure by Letters Patent is as follows:

1. An apparatus, comprising:

a calculator to provide a real-time estimate of a network traffic, said real-time estimate based on limited real-time data about the network traffic calculated in an offline phase and limited real-time data received in a real-time phase, wherein calculations in said offline phase comprise updating at least one descriptive traffic model of an entirety of said network, using recent historical traffic data, to calculate updated splitting percentages throughout said network, so that, during an online phase, said updated splitting percentages can be used to provide flow information for any traffic data that is currently unavailable.

2. The apparatus of claim 1, wherein:

calculations in said offline phase comprise:

receiving historical traffic data for said network;

expanding said historical data for an entirety of said network; and calculating said updated splitting percentages throughout said network, using said expanded historical data; and calculations in said online phase comprise:

expanding current traffic observation to said entirety of said network, as based on said offline calculations, using said updated splitting percentages.

3. The apparatus of claim 1, wherein said traffic comprises one of:

vehicular traffic on a network of roadways; and information packet traffic on a data or IP network.

4. The apparatus of claim 1, wherein said limited real-time data comprises traffic data of said network limited in at least one of spatially and temporally, relative to a complete current description of said traffic on said network.

5. The apparatus of claim 1, wherein calculations in said offline phase comprise prior information on traffic origin-destination flows.

6. The apparatus of claim 1, wherein calculations comprise at least one of real-time information and stored information on one or more incidents on the traffic network, said incidents each comprising an event disruptive to a normal traffic on at least a portion of said traffic network.

7. A computerized method of estimating traffic in a network, said method comprising:

calculating, using a processor on a computer, a real-time estimate of the network traffic, said real-time estimate based on limited real-time data about the network traffic calculated in an offline phase and limited real-time data received in a real-time phase, wherein calculations in said offline phase comprise updating at least one descriptive traffic model of an entirety of said network, using recent historical traffic data, to calculate updated splitting percentages throughout said network, so that, during an online phase, said updated splitting percentages can be used to provide flow information for any traffic data that is currently unavailable.

8. The method of claim 7, wherein:

calculations in said offline phase comprise:

receiving historical traffic data for said network;

expanding said historical data for an entirety of said network;

calculating said updated splitting percentages throughout said network, using said expanded historical data; and calculations in said online phase comprise:

expanding current traffic observation to said entirety of said network, as based on said offline calculations, using said updated splitting percentages.

9. The method of claim 7, wherein said traffic comprises one of:

vehicular traffic on a network of roadways; and information packet traffic on a data or IP network.

10. The method of claim 7, wherein said limited real-time data comprises traffic data of said network limited in at least one of spatially and temporally, relative to a complete current description of said traffic on said network.

11. The method of claim 7, wherein calculations in said offline phase comprise prior information on traffic origin-destination flows.

12. The method of claim 7, wherein calculations comprise at least one of real-time information and stored information on one or more incidents on the traffic network, said incidents each comprising an event disruptive to a normal traffic on at least a portion of said traffic network.

13. A computer-readable storage medium tangibly encoded with a program of machine-readable instructions executable by a digital processing apparatus to perform a computerized method of estimating traffic in a network, said method comprising:

calculating a real-time estimate of the network traffic, said real-time estimate based on limited real-time data about the network traffic calculated in an offline phase and limited real-time data received in a real-time phase, wherein calculations in said offline phase comprise updating at least one descriptive traffic model of an entirety of said network, using recent historical traffic data, to calculate updated splitting percentages throughout said network, so that, during an online phase, said updated splitting percentages can be used to provide flow information for any traffic data that is currently unavailable.

14. The computer-readable storage medium of claim 13, wherein:

calculations in said offline phase comprise:

receiving historical traffic data for said network;

expanding said historical data for an entirety of said network; and calculating said updated splitting percentages throughout said network, using said expanded historical data; and calculations in said online phase comprise:

expanding current traffic observation to said entirety of said network, as based on said offline calculations, using said updated splitting percentages.

15. The computer-readable storage medium of claim 13, wherein said traffic comprises one of:

vehicular traffic on a network of roadways; and information packet traffic on a data or IP network.

16. The computer-readable storage medium of claim 13, wherein said limited real-time data comprises traffic data of said network limited in at least one of spatially and temporally, relative to a complete current description of said traffic on said network.

17. The computer-readable storage medium of claim 13, wherein calculations in said offline phase comprise prior information on traffic origin-destination flows.

18. The apparatus of claim 1, wherein said splitting percentages are calculated based on determining weight factors on flow data for links of said network, using said historical traffic data as expanded to include all nodes of the entire network, such that an assumed equilibrium will exist for said entire network using said determined weight factors.

19. The apparatus of claim 18, wherein said weight factors are restricted such that all flow into a node is presumed to be propagated in same proportions, thereby arriving at an average-based formulation.

20. The apparatus of claim 18, wherein said weight factors are not restricted such that all flow into a node is presumed to be propagated in same proportions, thereby arriving at an observation-based formulation.

* * * * *